US009718616B1

(12) United States Patent
Deming et al.

(10) Patent No.: US 9,718,616 B1
(45) Date of Patent: Aug. 1, 2017

(54) DUMPSTER LID STOP BRACKET TO LIMIT TRAVEL OF THE LID

(71) Applicants: Paul Allen Deming, Visalia, CA (US); John J. Salas, Visalia, CA (US)

(72) Inventors: Paul Allen Deming, Visalia, CA (US); John J. Salas, Visalia, CA (US)

( * ) Notice: Subject to any disclaimer, the term of this patent is extended or adjusted under 35 U.S.C. 154(b) by 0 days.

(21) Appl. No.: 15/271,471

(22) Filed: Sep. 21, 2016

Related U.S. Application Data

(60) Provisional application No. 62/221,195, filed on Sep. 21, 2015.

(51) Int. Cl.
*B65D 43/24* (2006.01)
*B65F 1/16* (2006.01)

(52) U.S. Cl.
CPC .... *B65F 1/1646* (2013.01); *B65F 2001/1669* (2013.01)

(58) Field of Classification Search
CPC .. B65F 2001/1669; B65F 1/1646; B65F 1/16; B65F 1/14; Y10T 16/551; B65D 43/24
See application file for complete search history.

(56) References Cited

U.S. PATENT DOCUMENTS 2,563,456 A * 8/1951 Brownell ..... B65F 1/163 220/263
3,450,297 A * 6/1969 Clerk ..... B65F 1/163 220/263
4,186,844 A * 2/1980 Swanson ..... B65F 1/16 220/817
4,609,117 A * 9/1986 Pamment ..... B65F 1/1623 220/252
5,085,341 A * 2/1992 Hodge ..... B65F 1/1615 220/811
5,201,434 A * 4/1993 DeVivo ..... B65F 1/122 220/315
5,595,317 A * 1/1997 Hodge ..... B65F 1/16 16/250
5,997,052 A * 12/1999 Reeb ..... B65F 1/1615 292/148
6,276,562 B1 * 8/2001 Hodge ..... B65F 1/1646 16/343
8,308,009 B2 * 11/2012 Joordens ..... B65F 1/08 220/260
9,051,869 B2 * 6/2015 Zhang ..... F01N 13/085
9,233,793 B1 * 1/2016 Jackson ..... B65F 1/1646

* cited by examiner

*Primary Examiner* — Bradley Duckworth
(74) *Attorney, Agent, or Firm* — Plager Schack LLP

(57) ABSTRACT

A dumpster lid stop bracket to limit travel of a lid pivotably mounted to a dumpster body by a hinge pin is provided. The stop bracket includes an elongated bar having a first straight section, a bent section continuously connected to the first straight section, and a second straight section continuously connected to the bent section, a spring clip slidably mounted to the elongated bar and having a pair of openings to receive the first and second straight sections of the elongated bar. Space within the spring clip and first and second straight sections permit the dumpster's hinge pin to extend therethrough. Pivotal movement of the lid to an open position permits the elongated bar's bent section to contact a side wall of the dumpster body and both the first and second straight sections to contact the lid, thereby enabling the stop bracket to limit travel of the lid.

5 Claims, 3 Drawing Sheets

DUMPSTER LID STOP BRACKET TO LIMIT TRAVEL OF THE LID

RELATED APPLICATION

The application claims priority to provisional patent application U.S. Ser. No. 62/221,195 filed on Sep. 21, 2015, the entire contents of which is herein incorporated by reference.

BACKGROUND

The embodiments herein relate generally to dumpsters used to collect refuse.

Large dumpsters are often placed outdoors to conveniently store refuse at one location to make it easy for trash collection trucks to pick up and dispose the waste properly. These dumpsters generally comprise compartments disposed on the ground. Each dumpster comprises a lid pivotably mounted to the compartment by a hinge pin to permit the lid to open and close as needed. One common problem faced is that users often inadvertently push the dumpster's lid too far, which causes the lid to pivot around and rest against the side wall of the dumpster. The lid is heavy and requires the user to awkwardly lift and pivot the lid back around to close the dumpster.

There exist wedge devices designed for use in limiting the travel of dumpster lids. However, these wedge devices are undesirable because they damage the lid and require significant time and effort to install. In particular, tools such as drills are required to secure the wedge devices to the dumpster lid. This process promotes wear and damage to the lid components. In addition, the hinge pin of the dumpster has to be removed during the process of installing the wedge device. This is inefficient and a burden to the user.

As such, there is a need in the industry for a dumpster lid stop bracket that addresses the limitations of the prior art and effectively limits the travel of the dumpster's lid. There is a further need for the stop bracket to mount to the dumpster lid easily without the use of tools or specialized skills.

SUMMARY

A dumpster lid stop bracket configured to limit travel of a lid pivotably mounted to a dumpster body by a hinge pin is provided. The dumpster lid stop bracket comprises an elongated bar comprising a first straight section, a bent section continuously connected to the first straight section, and a second straight section continuously connected to the bent section, the second straight section extending adjacent and generally parallel to the first straight section, a generally V-shaped spring clip slidably mounted to the elongated bar and positioned proximate the bent section of the elongated bar, the spring clip comprising a pair of openings configured to receive the first and second straight sections of the elongated bar therethrough, wherein space within the V-shaped spring clip and first and second straight sections is configured to permit the hinge pin of the dumpster to extend therethrough, wherein pivotal movement of the lid to an open position permits the bent section of the elongated bar to contact a side wall of the dumpster body and both the first and second straight sections to contact the lid, thereby enabling the stop bracket to limit travel of the lid.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
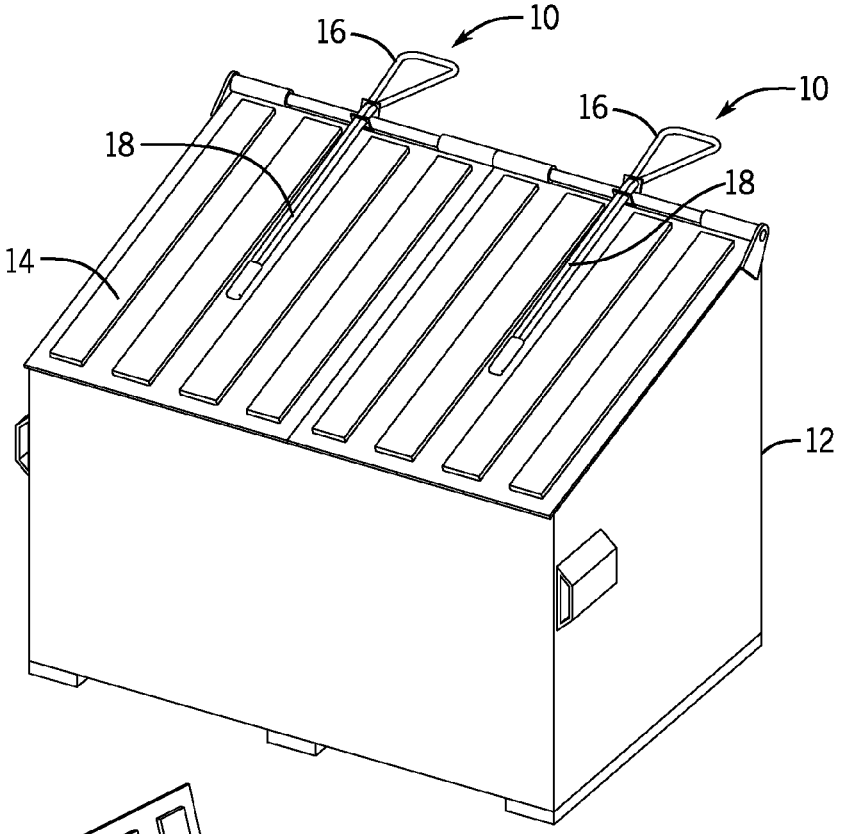
FIG. 1 depicts a front perspective view of certain embodiments of the dumpster lid stop bracket shown in use.

As depicted in FIGS. 1-5, stop bracket 10 is configured for use with dumpster 12 to limit the travel of lid 14. Dumpster 12 may be any type of dumpster comprising one or more lids 14 pivotably mounted to a dumpster body by hinge pin 22. It shall be appreciated that stop bracket 10 is coupled to hinge pin 22 for each lid 14 of dumpster 12. In a preferred embodiment, stop bracket 10 permits pivotal movement of lid 14 relative to the dumpster body from the closed position up to approximately 90 degrees. This prevents lid 14 from pivoting around and against a side wall of dumpster 12.

Stop bracket 10 generally comprises clip 24 and an elongated bar comprising a pair of straight sections 18 and bent section 16. The elongated bar comprises a first straight section 18 continuously connected to bent section 16, which is continuously connected to a second straight section 18. The pair of straight sections 18 extend adjacent and generally parallel to each other. In one embodiment, the pair of straight sections 18 are in contact with each other. In one embodiment, bent section 16 of the elongated bar comprises a generally triangular shape with rounded end corners. Bent section 16 is angled downward relative to straight sections 18 in the elongated bar. As a result, bent section 16 is positioned within a first plane and straight sections 18 are positioned within a second plane.

In a preferred embodiment, the elongated rod is made from carbon steel with a diameter of approximately ¼". The elongated rod preferably comprises an anti-corrosive coating such as phosphorus. In one embodiment, the elongated bar comprises a length of approximately 18" with each straight section 18 comprising a length of approximately 12" and bent section 16 comprising a length of approximately 6". However, it shall be appreciated that the dimensions of the elongated bar may vary to accommodate different sized dumpsters.

Figure 4:
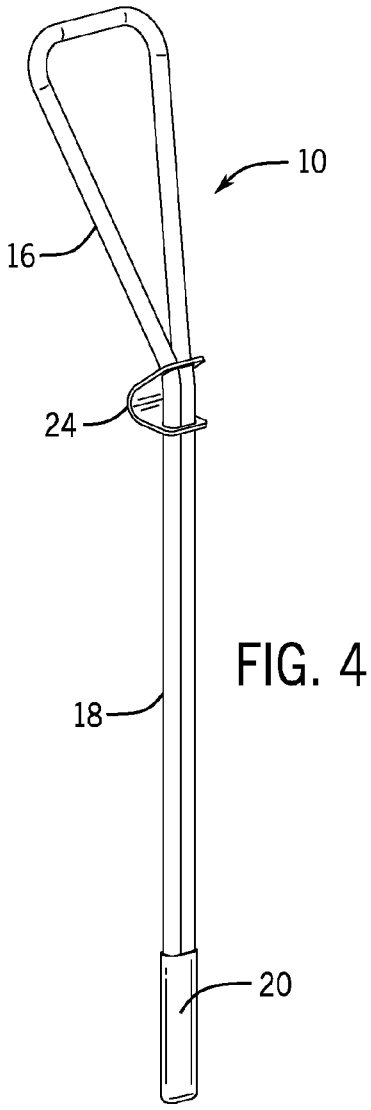
FIG. 4 depicts a perspective view of certain embodiments of the dumpster lid stop bracket.
Figure 5:
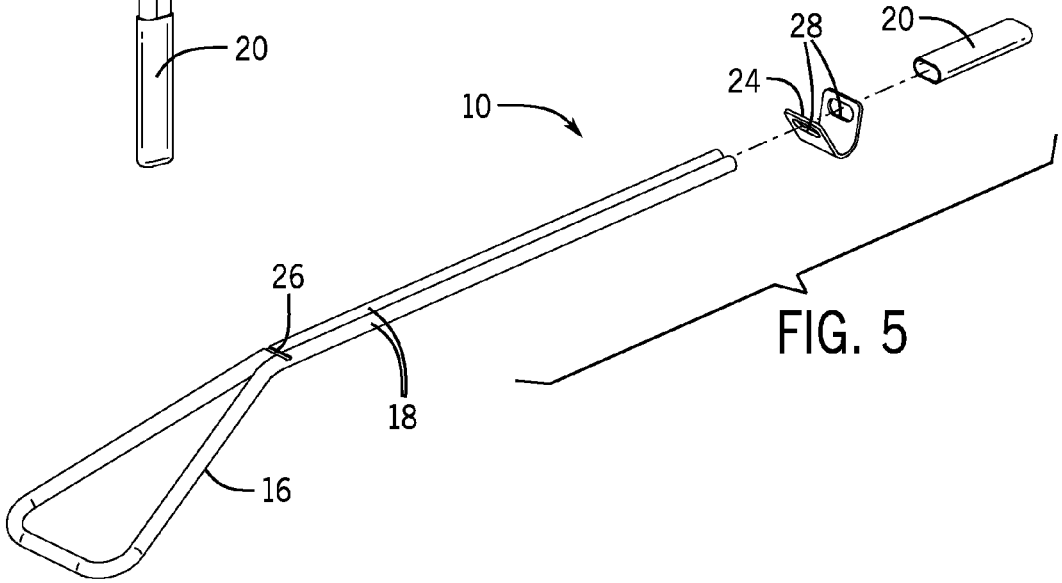
FIG. 5 depicts an exploded view of certain embodiments of the dumpster lid stop bracket.

As depicted in FIGS. 4-5, end cap 20 is disposed around ends of straight sections 18. In a preferred embodiment, end cap 20 is made from vinyl and comprises an approximate length of 4". End cap 20 is configured to prevent the sharp ends of straight sections 18 from damaging lid 14. Clip 24 is a generally V-shaped spring clip made from T304 stainless steel and comprises a pair of openings 28. Openings 28 of clip 24 are configured to receive straight sections 18 of the elongated bar. This permits clip 24 to be slidably mounted to the elongated bar. In a preferred embodiment, straight sections 18 comprise notches 26 aligned together and positioned proximate bent section 16.

Figure 2:
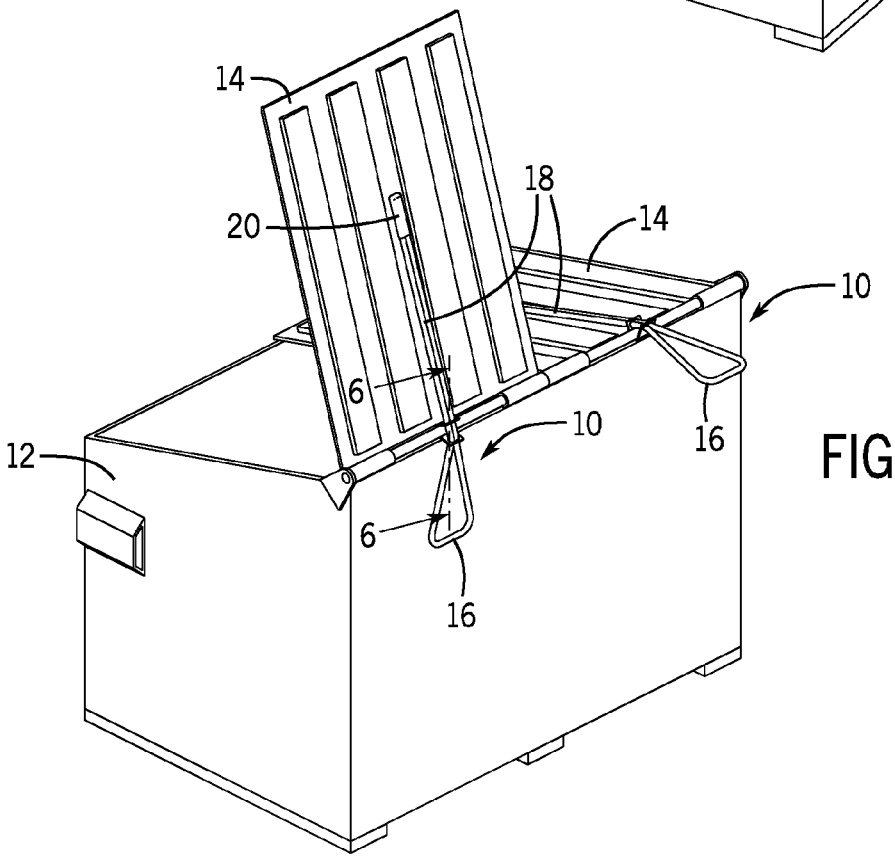
FIG. 2 depicts a rear perspective view of certain embodiments of the dumpster lid stop bracket shown in use.
Figure 3:
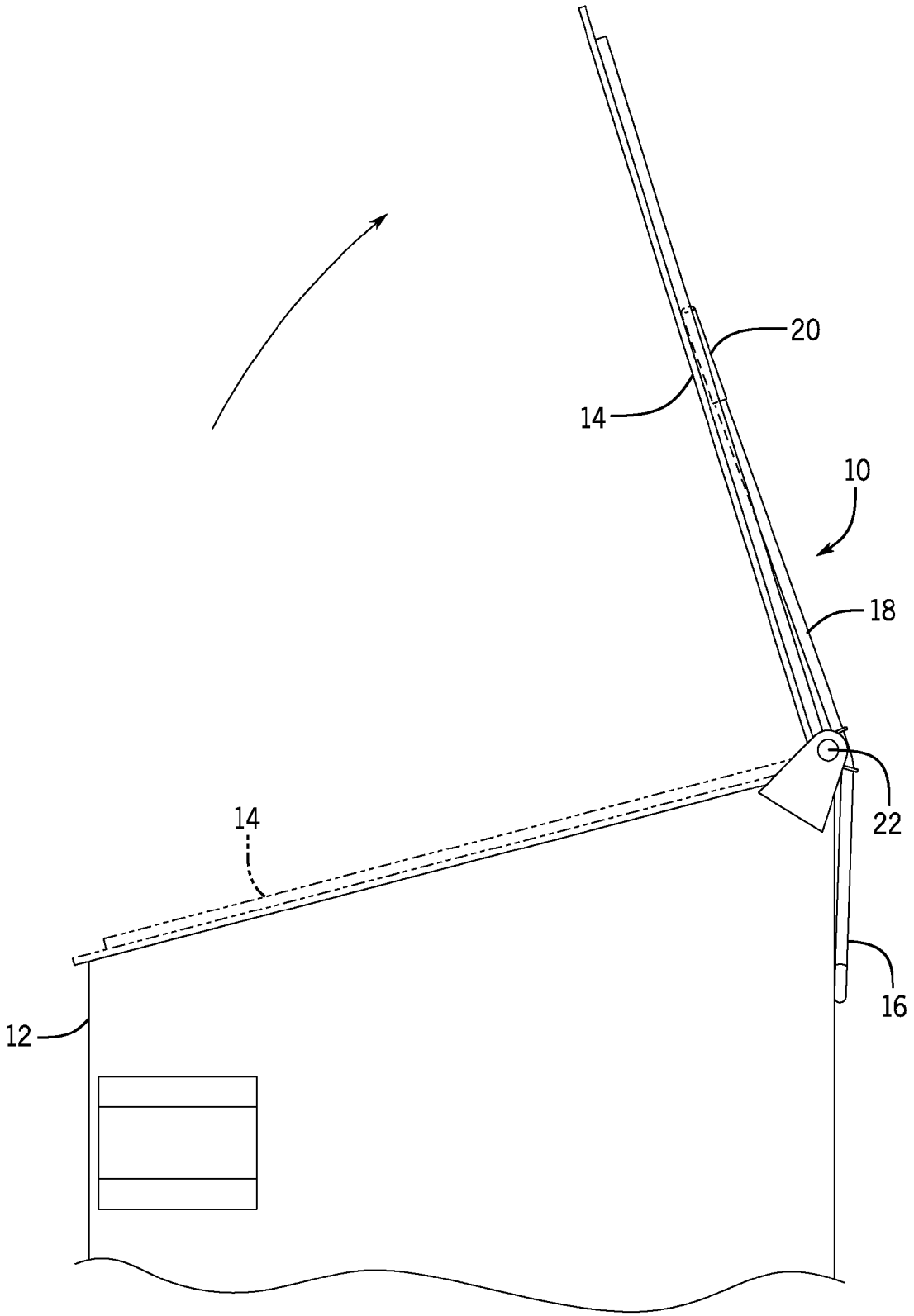
FIG. 3 depicts a side view of certain embodiments of the dumpster lid stop bracket shown in use.
Figure 6:
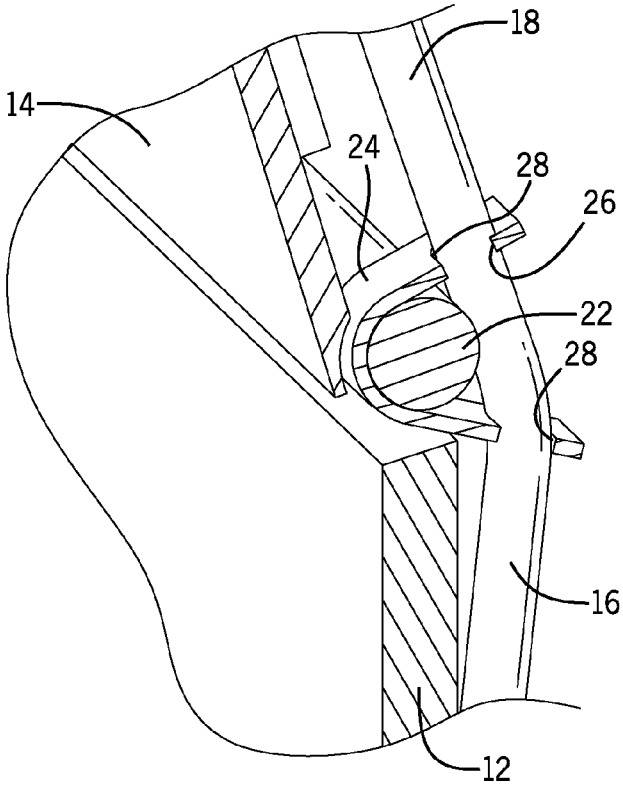
FIG. 6 depicts a sectional view of certain embodiments of the dumpster lid stop bracket taken along line 6-6 in FIG. 2.

In operation of stop bracket 10, clip 24 is positioned around and below hinge pin 22 of dumpster 12. Straight sections 18 of the elongated bar are inserted through openings 28 of clip 24 until the edge of one opening 18 engages with notches 26 of the elongated bar as shown in FIG. 6. This installation is completed for each lid 14 of dumpster 12 as shown in FIG. 1. As depicted in FIGS. 2-3 and 6, pivotal movement of lid 14 to the open position causes bent section 16 of the elongated bar to contact a sidewall of dumpster 12 and straight sections 18 of the elongated bar to contact lid 14. In this position, stop bracket 10 limits further pivotal movement of lid 14 toward the side wall of dumpster 12. Once released, lid 14 automatically drops down to the closed position to cover the dumpster body.

It shall be appreciated that the components of stop bracket 10 described in several embodiments herein may comprise any alternative known materials in the field and be of any color, size and/or dimensions. It shall be appreciated that the components of stop bracket 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A dumpster lid stop bracket configured to limit travel of a lid pivotably mounted to a dumpster body by a hinge pin, the dumpster lid stop bracket comprising:

an elongated bar comprising a first straight section, a bent section continuously connected to the first straight section, and a second straight section continuously connected to the bent section, the second straight section extending adjacent and generally parallel to the first straight section;

a generally V-shaped spring clip slidably mounted to the elongated bar and positioned proximate the bent section of the elongated bar, the spring clip comprising a pair of openings configured to receive the first and second straight sections of the elongated bar therethrough, wherein space within the V-shaped spring clip and first and second straight sections is configured to permit the hinge pin of the dumpster to extend therethrough;

wherein pivotal movement of the lid to an open position permits the bent section of the elongated bar to contact a side wall of the dumpster body and both the first and second straight sections to contact the lid, thereby enabling the stop bracket to limit travel of the lid.

2. The dumpster lid stop bracket of claim 1, wherein the bent section of the elongated bar comprises a generally triangular shape.

3. The dumpster lid stop bracket of claim 2, further comprising an end cap disposed around ends of the first and second straight sections of the elongated bar.

4. The dumpster lid stop bracket of claim 3, further comprising a first notch disposed in the first straight section of the elongated bar and a second notch disposed in the second straight section of the elongated bar, wherein the first and second notches are configured to engage with an edge of one of the pair of openings in the V-shaped spring clip.

5. The dumpster lid stop bracket of claim 4, wherein the generally triangular shaped bent section of the elongated bar is positioned within a first plane, wherein both the first and second straight sections of the elongated bar are positioned within a second plane.

* * * * *